US008239973B1

(12) United States Patent
Character

(10) Patent No.: US 8,239,973 B1
(45) Date of Patent: Aug. 14, 2012

(54) TOILET VENTILATION APPARATUS

(76) Inventor: Davis Character, Columbus, GA (US)

( * ) Notice: Subject to any disclaimer, the term of this patent is extended or adjusted under 35 U.S.C. 154(b) by 308 days.

(21) Appl. No.: 12/578,750

(22) Filed: Oct. 14, 2009

(51) Int. Cl.
*A47K 13/00* (2006.01)
*E03D 9/04* (2006.01)

(52) U.S. Cl. ..... 4/217; 4/211; 4/213; 4/219

(58) Field of Classification Search ..... 4/211, 213, 4/217, 219
See application file for complete search history.

(56) References Cited

U.S. PATENT DOCUMENTS 1,389,608 A * 9/1921 Trueman ..... 4/211
3,533,111 A * 10/1970 Bowman et al. ..... 4/211
3,649,972 A * 3/1972 Sowards ..... 4/211
4,402,091 A 9/1983 Ellis et al.
5,671,484 A * 9/1997 Lee, III ..... 4/213
6,055,677 A * 5/2000 McKinley ..... 4/217
D461,547 S 8/2002 Christian, Sr.
6,701,538 B2 3/2004 Hunnicutt, Jr. et al.
6,772,449 B1 8/2004 Wolfe
2003/0070212 A1 4/2003 Brodhead

* cited by examiner

*Primary Examiner* — Tuan N Nguyen

(57) ABSTRACT

The toilet ventilation apparatus effectively vents unwanted gasses from a toilet room without risk of return. The apparatus provides for installation to an existing toilet bowl with retention of the existing lid. The seat with bottom orifices is provided in a plurality of thicknesses, shapes, and sizes to correctly fit existing toilets. The discharge hose connects to the collar fitting of the drain collar, which is easily connected to a drain such as a sink drain so that in-floor and wall plumbing invasion is not required. The quick connect fitting is disposed between the escape tube exiting the rear of the seat and the suction hose. The quick connect provides that the vacuum pump and related hose are quickly selectively connected and disconnected to any seat of the apparatus installed on an existing toilet bowl, thereby allowing addition and removal of the pump and hoses at a few seconds notice.

8 Claims, 4 Drawing Sheets

TOILET VENTILATION APPARATUS

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

Ventilated toilets are well known in the art. Ventilated toilet devices are a crowded field that seeks to improve over the inefficiency of entire toilet room ventilation such as ceiling suction fans. In the field, various small differences can make a significant change in the efficacy of toilet ventilation devices. The most desirable of such devices mimic a typical toilet seat top as much as is possible. What must be considered in such devices is orifice number and size in the toilet seat, passage sizing, fittings to the toilet seat, and choice of disposal of unwanted gasses from the seat area and out of the toilet room. The present apparatus provides unique solutions to these problems.

FIELD OF THE INVENTION

The toilet ventilation apparatus relates to ventilated toilets and more especially to a ventilating toilet seat with selectively pivotally affixed quick connect, flex hoses, and a specialized drain collar for gas removal from a toilet room.

SUMMARY OF THE INVENTION

The general purpose of the toilet ventilation apparatus, described subsequently in greater detail, is to provide a toilet ventilation apparatus which has many novel features that result in an improved toilet ventilation apparatus which is not anticipated, rendered obvious, suggested, or even implied by prior art, either alone or in combination thereof.

To attain this, the toilet ventilation apparatus effectively vents unwanted gasses from a toilet room without risk of gas return. The apparatus provides for installation to an existing toilet bowl with retention of the existing lid. The seat with seat bottom orifices is provided in a plurality of thicknesses, shapes, and sizes to correctly fit a plurality of existing toilets. The discharge hose connects to the collar fitting of the drain collar, which is easily connected to a drain such as a sink drain so that in-floor and wall plumbing invasion is not required. While the drain collar is provided in various sizes, the ideal diameter of the drain collar fits existing 1½ drains, thereby further providing for quick installation of the collar.

Further installation rapidity is provided by the quick connect fitting disposed between the escape tube exiting the rear of the seat and the suction hose. Additionally, the quick connect provides that the vacuum pump and related hose are quickly selectively connected and disconnected to any seat of the apparatus installed on an existing toilet bowl, thereby allowing addition and removal of the pump and hoses at a few seconds notice.

Thus has been broadly outlined the more important features of the improved toilet ventilation apparatus so that the detailed description thereof that follows may be better understood and in order that the present contribution to the art may be better appreciated.

An object of the toilet ventilation apparatus is to ventilate unpleasant gasses and smells from a toilet room.

Another object of the toilet ventilation apparatus is to provide for fit to most typical toilets.

A further object of the toilet ventilation apparatus is to provide only seat replacement in ventilating the toilet room and toilet.

An added object of the toilet ventilation apparatus is to provide for selectively using the apparatus on a plurality of toilets with interchangeability of the hoses and vacuum pump.

And, an object of the toilet ventilation apparatus is to provide for quick installation of the apparatus.

Yet another object of the toilet ventilation apparatus is to negate the need for invasion of in-floor and wall plumbing in apparatus hookup.

Another object of the toilet ventilation apparatus is to ventilate unwanted gasses such that there is no gaseous return into the toilet area.

These together with additional objects, features and advantages of the improved toilet ventilation apparatus will be readily apparent to those of ordinary skill in the art upon reading the following detailed description of presently preferred, but nonetheless illustrative, embodiments of the improved toilet ventilation apparatus when taken in conjunction with the accompanying drawings.

In this respect, before explaining the current embodiments of the improved toilet ventilation apparatus in detail, it is to be understood that the toilet ventilation apparatus is not limited in its application to the details of construction and arrangements of the components set forth in the following description or illustration. Those skilled in the art will appreciate that the concept of this disclosure may be readily utilized as a basis for the design of other structures, methods, and systems for carrying out the several purposes of the improved toilet ventilation apparatus. It is therefore important that the claims be regarded as including such equivalent constructions insofar as they do not depart from the spirit and scope of the toilet ventilation apparatus. It is also to be understood that the phraseology and terminology employed herein are for purposes of description and should not be regarded as limiting.

DETAILED DESCRIPTION OF THE DRAWINGS

With reference now to the drawings, and in particular FIGS. 1 through 5 thereof, the principles and concepts of the toilet ventilation apparatus generally designated by the reference number 10 will be described.

Figure 1:
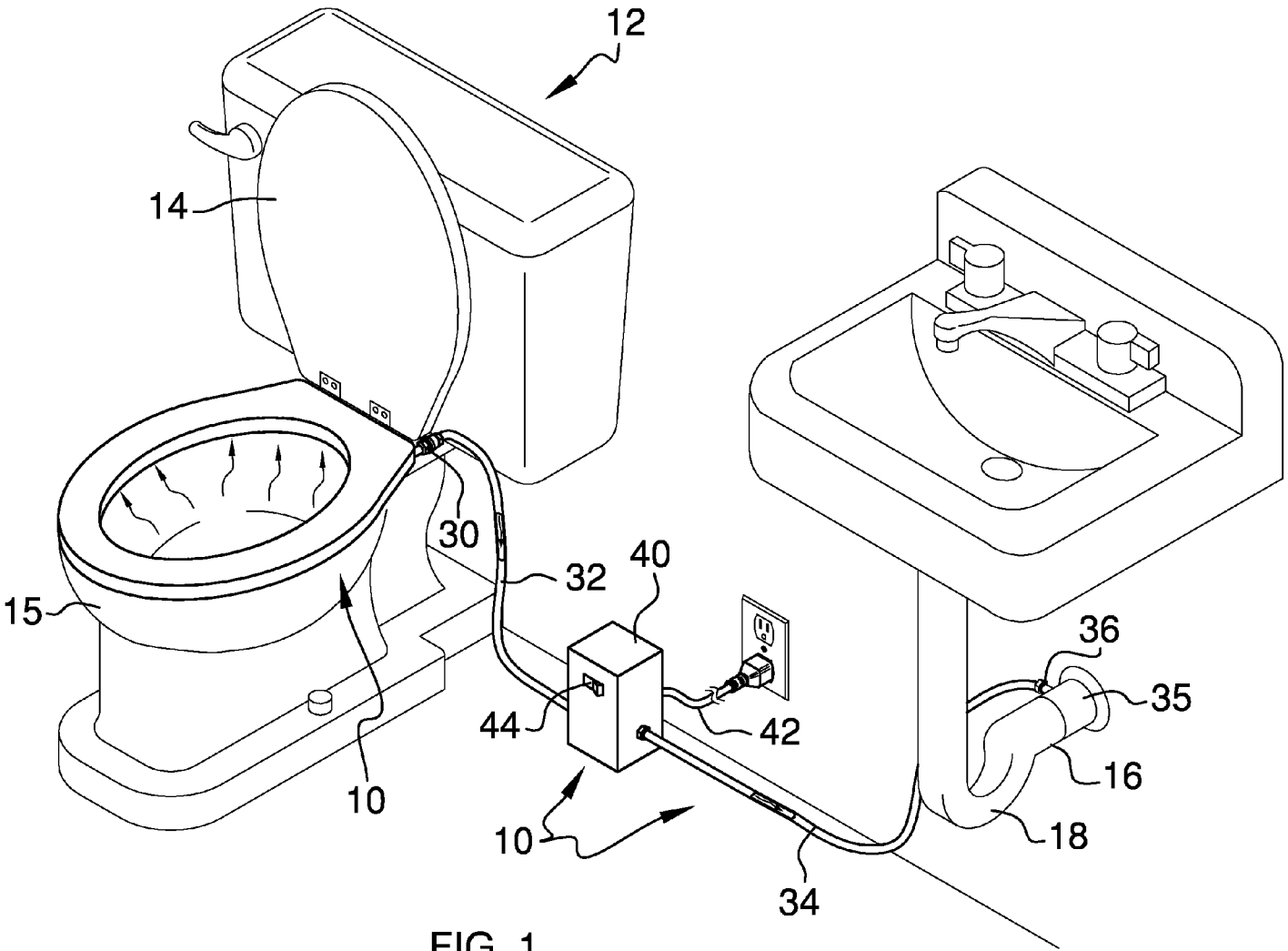
FIG. 1 is a perspective view of the apparatus installed.
Figure 2:
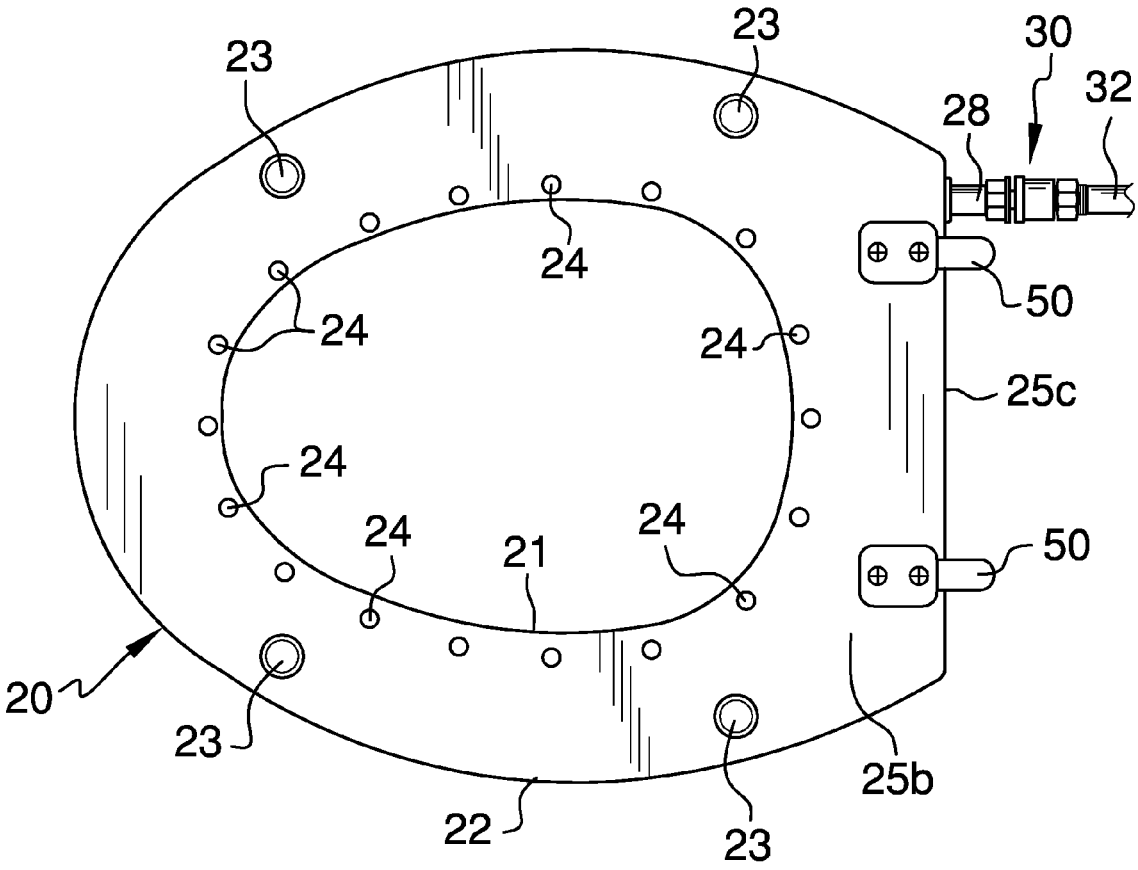
FIG. 2 is a bottom plan view of the seat and of the quick connect fitting.

Referring to FIGS. 1 and 2, the seat 20 has a top 25*a* spaced apart from the bottom 25*b* and an inner perimeter 21 spaced apart from the outer perimeter 22. The seat further comprises a rear 25*c*.

Figure 3:
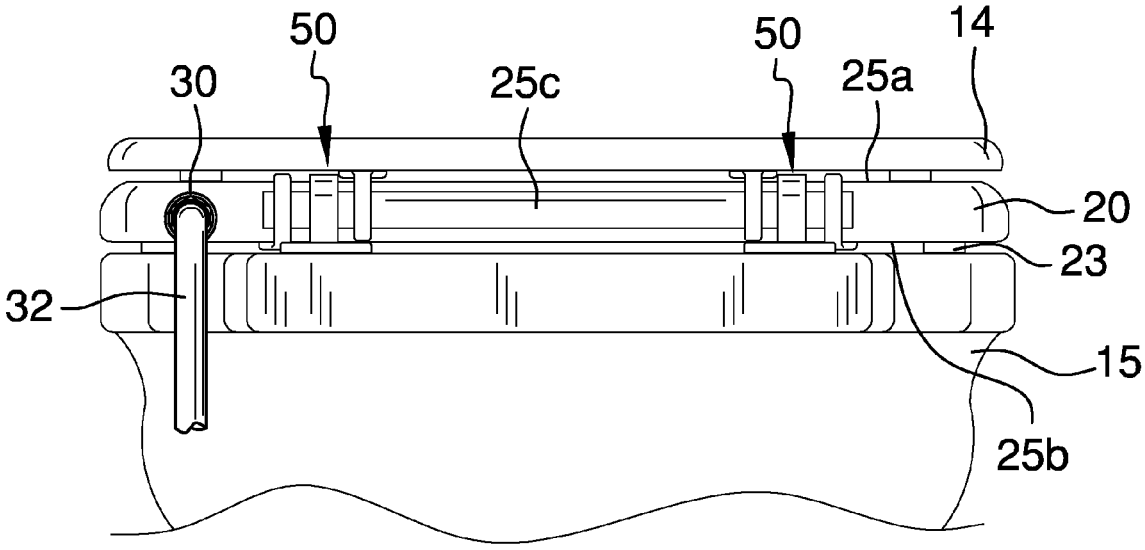
FIG. 3 is a rear elevation view of the installed seat.

Referring to FIG. 3, the seat 20 further comprises the pair of spaced apart hinges 50 selectively affixing the seat 20 to an existing bowl 15 of an existing toilet 12. The seat 20 is provided in a plurality of sizes and thickness to correctly fit most existing bowls 15 and to retain the use of the existing lids 14.

Referring again to FIG. 2, the quartet of spaced apart stops 23 is disposed on the seat bottom 25*b* proximal to the outer perimeter 22.

Figure 4:
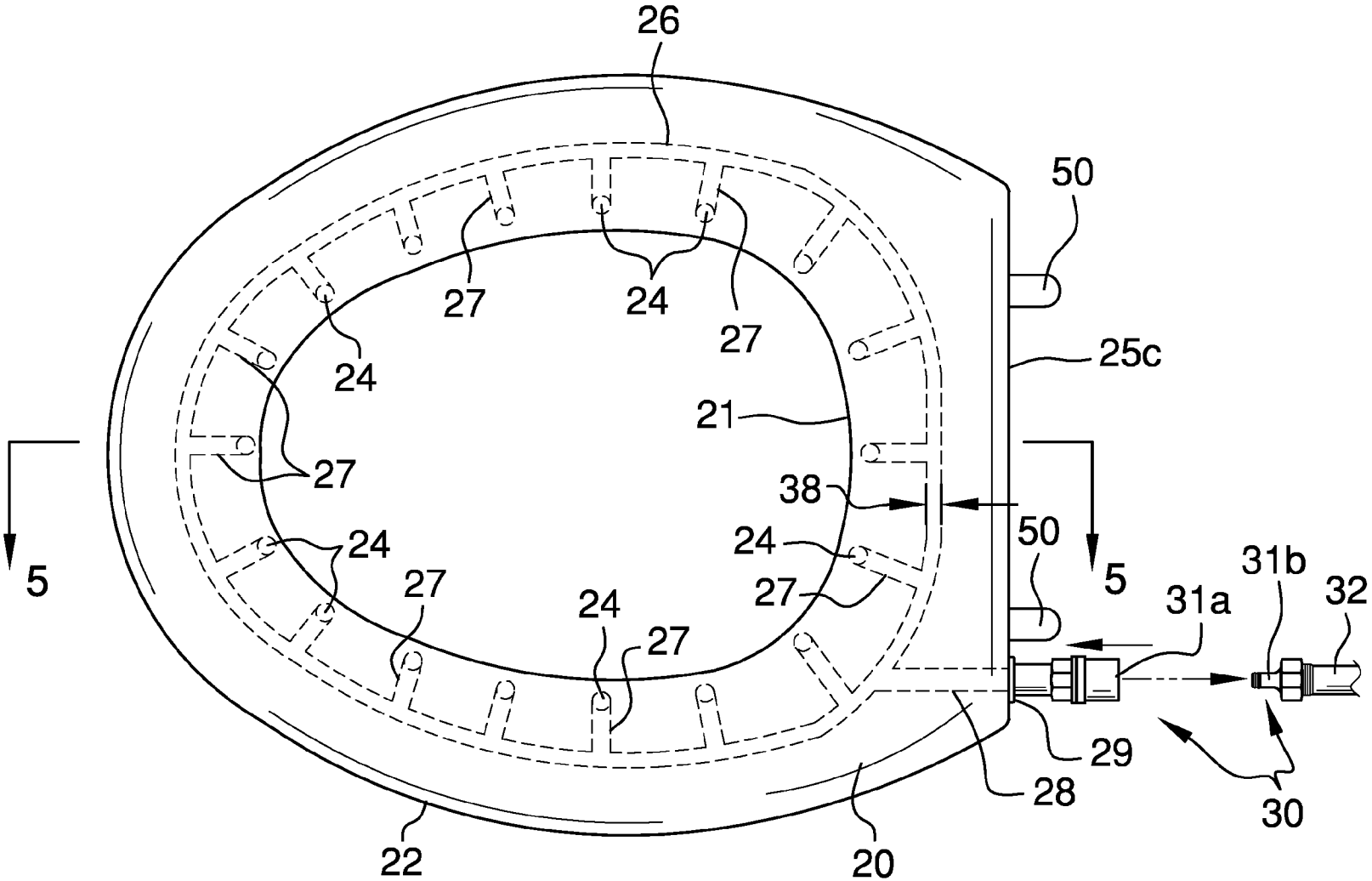
FIG. 4 is a top plan view of the installed seat and quick connect fitting.
Figure 5:
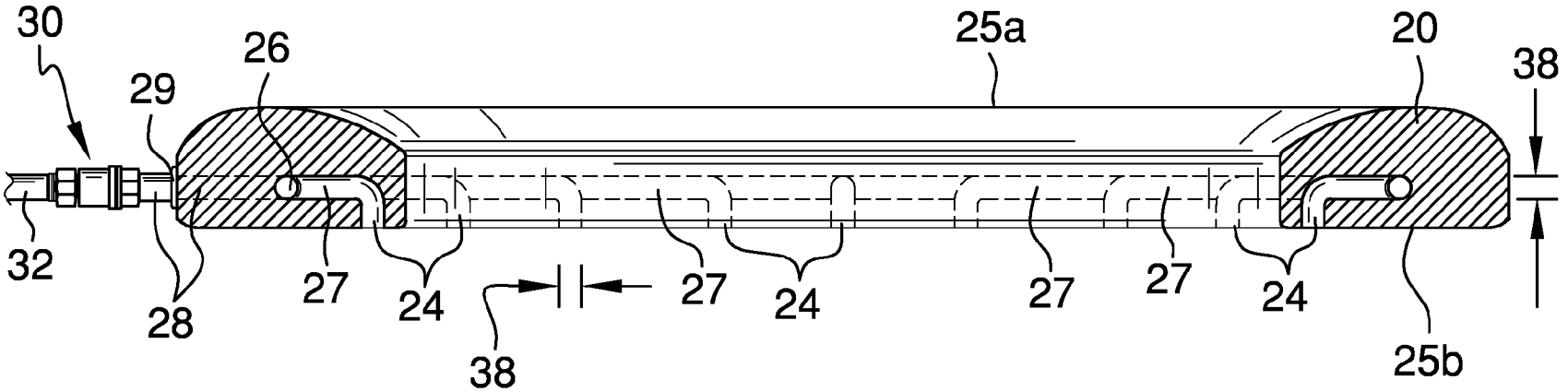
FIG. 5 is a cross sectional view of FIG. 4, taken along the line 5-5.

Continuing to refer to FIG. 2 and referring also to FIGS. 4 and 5, the plurality of orifices 24 is disposed within the seat 20 bottom 25*b*. The orifices 24 ideally number 18 and are disposed adjacent to the inner perimeter 21 for best gas acquisition.

The seat 20 bottom 25*b* location of the orifices 24 also helps for the seat 20 appear more like a typical existing seat. The interior passage 26 is disposed throughout the seat 20 between the inner perimeter 21 and the outer perimeter 22. A connecting passage 27 connects each orifice 24 to the interior passage 26 so that the interior passage can importantly be located about evenly between the inner perimeter 21 and the outer perimeter 22, thereby importantly assisting in seat 20 structural integrity.

Continuing to refer to FIGS. 4 and 5 and referring also to FIG. 3, the escape tube 28 is connected to the interior passage 26 and passed out the seat 20 rear 25*c*. The moisture proof seal 29 is disposed around the escape tube 28 at the seat 20 rear 25*c* to shield against invasion of moisture and dirt at the seat 20 rear 25*c*.

Referring again to FIG. 1, the flexible suction hose 32 is connected to the escape tube 28 via the pivoting quick connect fitting 30. The vacuum pump 40 is connected to the discharge hose 34. The switch 44 disposed on the vacuum pump 40 provides selective control of the pump 40. The power cord 42 extends from the vacuum pump 40 and is removably plugged into an existing electrical outlet. The drain collar 35 is ideally sized to fit to an existing drain 16. The drain collar 35 is connected after the existing trap 18 so that gasses are not released back into a toilet room. Gasses are thereby vented to a sewer line. The collar fitting 36 is connected to the drain collar 35. The discharge hose 34 connects the vacuum pump 40 to the collar fitting 36.

The collar fitting 36 importantly provides for quick installation of the apparatus 10 with a minimum of time and tools as the fitting is ideally sized to fit existing 1½ inch drains 16.

Referring to FIGS. 4 and 5, the orifices comprise a diameter 38 of about ¼ inch. The connecting passages 27 further importantly comprise a diameter 38 of about ¼ inch. The interior passage further importantly comprises a diameter 38 of about ¼ inch. The diameters 38 of the passages provide best gas flow velocities to exiting gasses, thereby increasing the effectiveness of the apparatus 10 while negating any use of a high wattage vacuum pump 40. The quick connect fitting 30 provides easy attachment to and detachment from the suction hose 32 by way of the female release collar 31*a* on the escape tube that is selectively pulled back from the male insert 31*b* disposed on the suction hose 32. Pulling back on the female release collar 31*a* releases the male insert 31*b* for removal and for insertion.

With respect to the above description then, it is to be realized that the optimum dimensional relationships for the parts of the toilet ventilation apparatus, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the toilet ventilation apparatus.

Directional terms such as "front", "back", "in", "out", "downward", "upper", "lower", and the like may have been used in the description. These terms are applicable to the embodiments shown and described in conjunction with the drawings. These terms are merely used for the purpose of description in connection with the drawings and do not necessarily apply to the position in which the toilet ventilation apparatus may be used.

Therefore, the foregoing is considered as illustrative only of the principles of the toilet ventilation apparatus. Further, since numerous modifications and changes will readily occur to those skilled in the art, it is not desired to limit the toilet ventilation apparatus to the exact construction and operation shown and described, and accordingly, all suitable modifications and equivalents may be resorted to, falling within the scope of the toilet ventilation apparatus.

What is claimed is:

1. A toilet ventilation apparatus comprising, in combination:

a seat having a top spaced apart from a bottom, an inner perimeter spaced apart from an outer perimeter, a rear;

a pair of spaced apart hinges selectively affixing the seat to an existing toilet bowl;

a quartet of spaced apart stops disposed on the seat bottom proximal to the outer perimeter;

a plurality of orifices disposed within the seat bottom adjacent to the inner perimeter;

an interior passage disposed throughout the seat between the inner perimeter and the outer perimeter;

an elongated connecting passage connecting each orifice to the interior passage;

an escape tube connected to the interior passage and passed out the seat rear;

a moisture proof seal disposed around the escape tube at the seat rear;

a flexible suction hose connected to the escape tube via a pivoting quick connect fitting, the quick connect fitting comprising:

a female release collar disposed on the escape tube, exterior to the seat back;

a male insert disposed on the suction hose;

a vacuum pump connected to the suction hose;

a switch disposed on the vacuum pump;

a power cord extended from the vacuum pump, the power cord removably plugged into an existing electrical outlet;

a drain collar fitted to an existing drain, the drain collar connected after an existing trap;

a collar fitting connecting the drain collar;

a flexible discharge hose connecting the vacuum pump to the collar fitting.

2. The apparatus according to claim 1 wherein the orifices further comprise a diameter of about ¼ inch.

3. The apparatus according to claim 2 wherein the drain collar further fits existing 1½ inch drains.

4. The apparatus according to claim 2 wherein the connecting passages further comprise a diameter of about ¼ inch.

5. The apparatus according to claim 4 wherein the drain collar further fits existing 1½ inch drains.

6. The apparatus according to claim 4 wherein the interior passage further comprises a diameter of about ¼ inch.

7. The apparatus according to claim 6 wherein the drain collar further fits existing 1½ inch drains.

8. The apparatus according to claim 1 wherein the drain collar further fits existing 1½ inch drains.

* * * * *